US008545215B2

(12) United States Patent
Bhagat

(10) Patent No.: US 8,545,215 B2
(45) Date of Patent: Oct. 1, 2013

(54) LATE LEAN INJECTION INJECTOR

(75) Inventor: Reena Bhagat, Jharkand (IN)

(73) Assignee: General Electric Company, Schenectady, NY (US)

( * ) Notice: Subject to any disclaimer, the term of this patent is extended or adjusted under 35 U.S.C. 154(b) by 807 days.

(21) Appl. No.: 12/781,190

(22) Filed: May 17, 2010

(65) Prior Publication Data

US 2011/0277481 A1 Nov. 17, 2011

(51) Int. Cl.
*F23R 3/28* (2006.01)

(52) U.S. Cl.
USPC ..... 431/173; 60/737; 60/738; 239/423; 239/424

(58) Field of Classification Search
USPC ..... 60/748, 737, 740, 738; 239/423, 239/424, 426, 433, 434, 434.5; 431/9, 185
See application file for complete search history.

(56) References Cited

U.S. PATENT DOCUMENTS 3,403,976 A 10/1968 Ceresna et al.
3,740,203 A 6/1973 Nezat
4,790,666 A 12/1988 Koziol
4,928,481 A * 5/1990 Joshi et al. ..... 60/737
5,129,930 A 7/1992 Gauthier et al.
5,220,888 A * 6/1993 Khinkis et al. ..... 431/173
5,461,865 A 10/1995 Snyder et al.
5,657,631 A * 8/1997 Androsov ..... 60/737
5,896,739 A 4/1999 Snyder et al.
5,899,389 A 5/1999 Pataki et al.
5,908,160 A 6/1999 Kramer et al.
6,141,954 A 11/2000 Sowa et al.
6,513,329 B1 2/2003 Snyder et al.
6,609,376 B2 * 8/2003 Rokke ..... 60/748
6,901,760 B2 * 6/2005 Dittmann et al. ..... 60/737

* cited by examiner

*Primary Examiner* — Ted Kim
(74) *Attorney, Agent, or Firm* — Cantor Colburn LLP

(57) ABSTRACT

A fuel injector is provided and includes an outer body, a converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof and a fuel line to deliver fuel through at least the converging tubular body at the converging section to the converging annular passage in a substantially tangential direction relative to a circumferential curvature of the converging tubular body.

18 Claims, 3 Drawing Sheets

LATE LEAN INJECTION INJECTOR

BACKGROUND OF THE INVENTION

The subject matter disclosed herein relates to a combustor having a premixed injector.

In turbine engines and, in particular, gas turbine engines, fuels, such as gas and compressed air, are fed to a combustor where combustion thereof occurs. High temperature fluids generated from this combustion are then directed through a transition piece and into a turbine for power and/or electricity generation. Generally, the compressed air is fed to the combustor from a compressor and travels upstream toward the head end where it is mixed with the other fuels.

When the fuel/air mixture is combusted certain pollutants, such as Nitrous Oxides (NOx), are produced. Since NOx production is generally undesirable, recent efforts have been undertaken to reduce NOx production and emission. In some cases, these efforts have centered on encouraging more complete mixing of the air and fuel. In these and/or other cases, late lean injection (LLI) has also been employed.

The purpose of LLI is to reduce NOx formation by reducing the residence time of fuel and air within the combustor. This is achieved by injecting a portion of the fuel and air into the combustor at an axial location downstream from the main combustion zone. In this way, the LLI fuel and air are combusted but do not travel as far through the combustor as they otherwise would. As such, as long as sufficient fuel and air mixing occurs, the LLI fuel and air generally do not form as much NOx as would otherwise be produced.

BRIEF DESCRIPTION OF THE INVENTION

According to one aspect of the invention, a fuel injector is provided and includes an outer body, a converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof and a fuel line to deliver fuel through at least the converging tubular body at the converging section to the converging annular passage in a substantially tangential direction relative to a circumferential curvature of the converging tubular body.

According to another aspect of the invention, a fuel injector is provided and includes an outer body, a converging tubular body having a length that is similar to or longer than that of the outer body, the converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof and a fuel line to deliver fuel through at least the converging tubular body at the converging section to the converging annular passage in a substantially tangential direction relative to a circumferential curvature of the converging tubular body.

According to yet another aspect of the invention, a late lean injection (LLI) combustor is provided and includes a liner defining a passage along which a main flow proceeds from an upstream section at which combustion producing the main flow occurs and a fuel injector coupled to the liner downstream from the upstream section. The fuel injector includes an outer body, a converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof, which are respectively disposed within the liner and a fuel line to deliver fuel through at least the converging tubular body at the converging section to the converging annular passage in a substantially tangential direction relative to a circumferential curvature of the converging tubular body.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
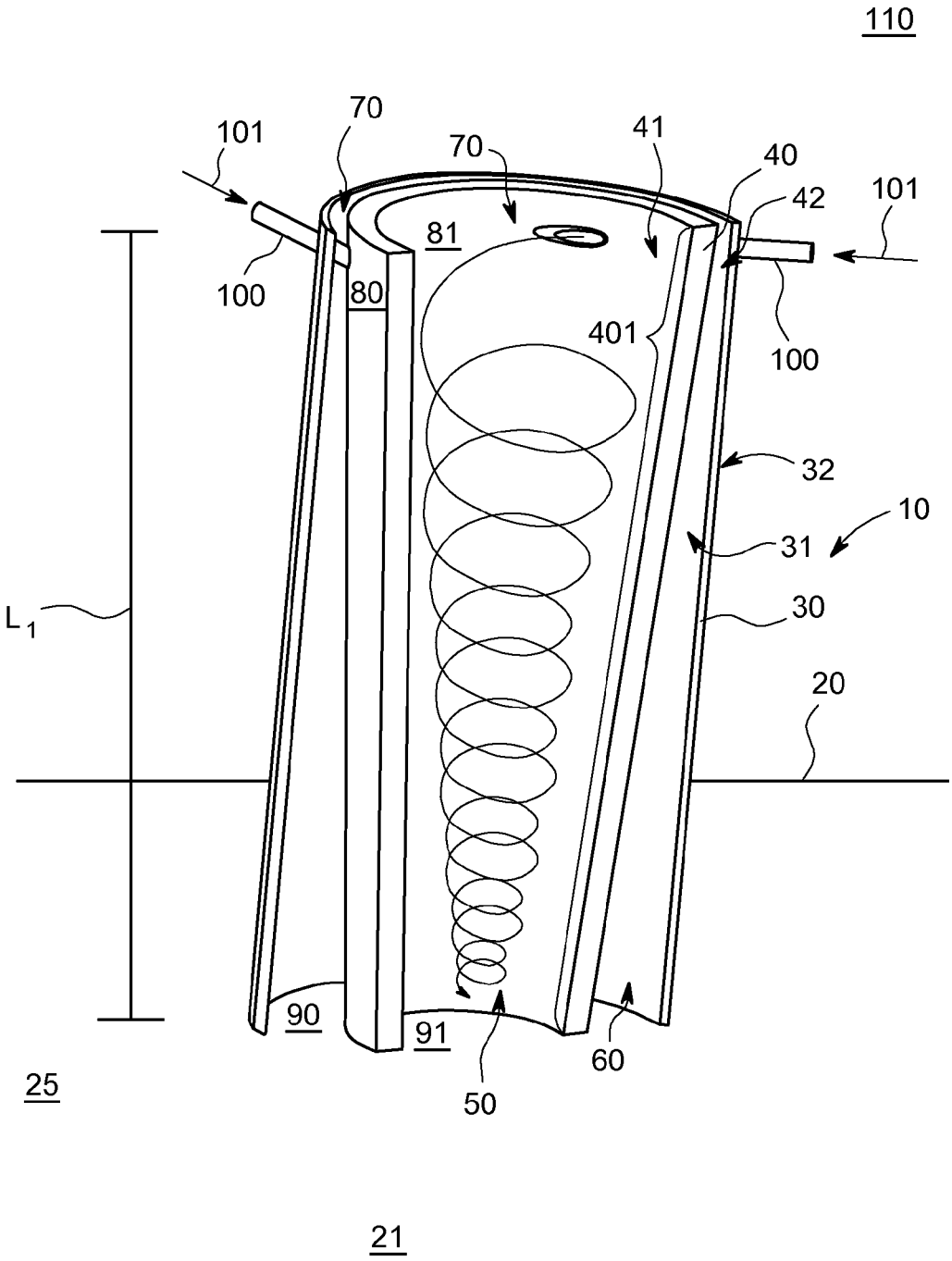
FIG. 1 is a perspective view of a fuel injector.
Figure 2:
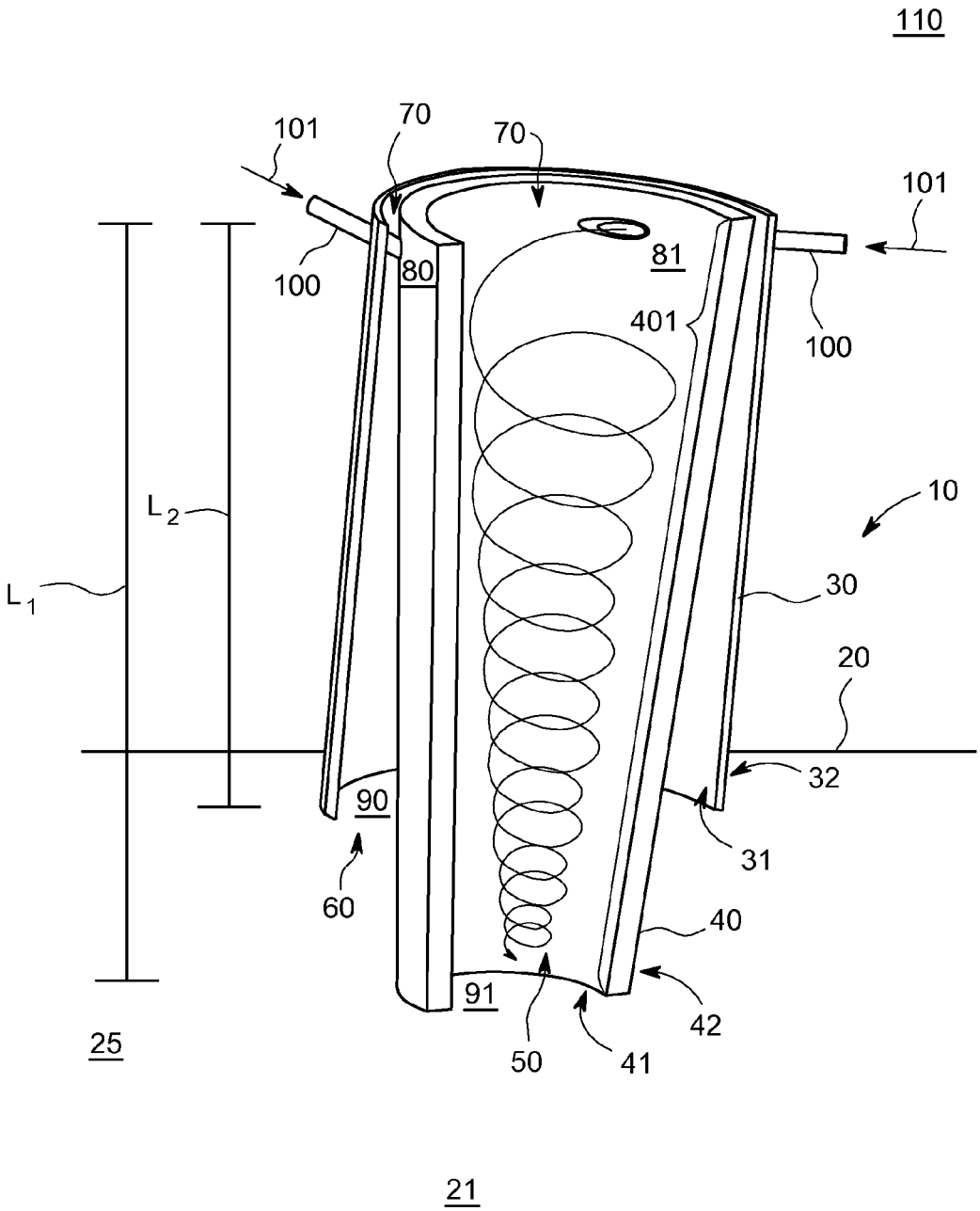
FIG. 2 is a perspective view of a fuel injector according to another embodiment.
Figure 3:
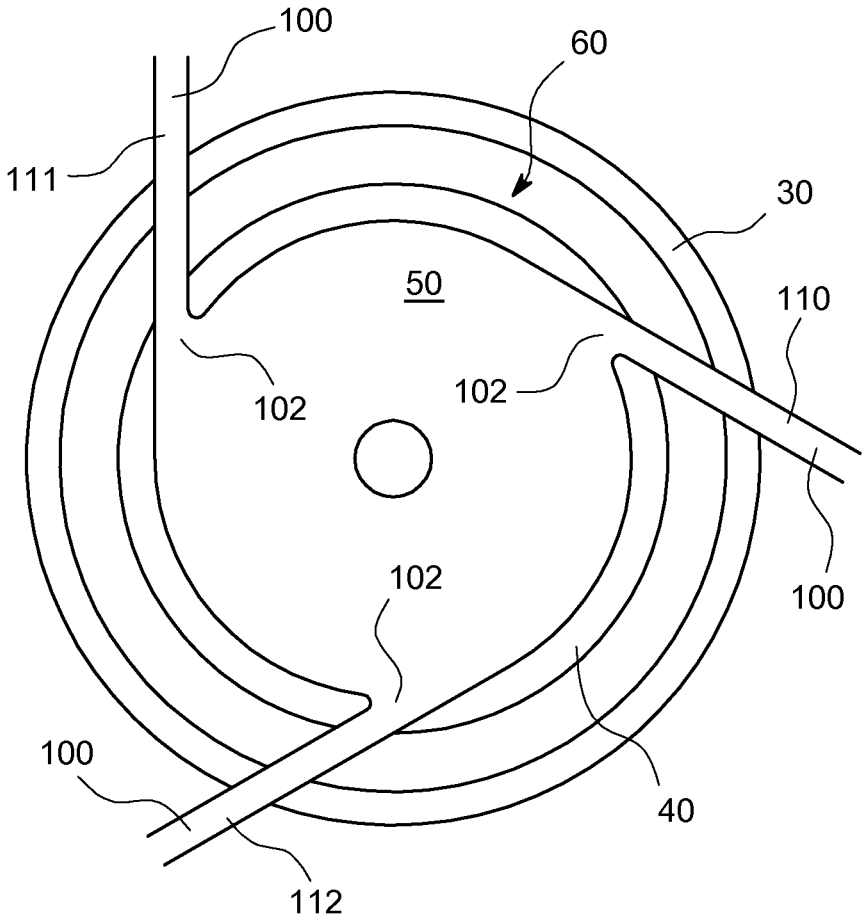
FIG. 3 is a view along an axis of the fuel injector of FIG. 1 or FIG. 2.

With reference to FIGS. 1-3, in order to increase the degree to which fuel and air mix within a combustor or, more particularly, a late lean injection (LLI) combustor, a fuel injector 10 is provided and is fluidly coupled to a combustor lining 20. The combustor lining 20 is formed to define an interior 21 along which a main fluid flow proceeds from an upstream section 25, which may be, in the case of the LLI combustor, a combustion zone.

The fuel injector 10 includes an outer body 30 having an interior annular surface 31 and an exterior annular surface 32, a converging tubular body 40 having an interior annular surface 41 and an exterior annular surface 42 and a fuel line 100. The converging tubular body 40 includes a converging section 401, which has a decreasing cross-sectional area from a first end thereof to a second end thereof, and which is formed to define a converging annular passage 50 therein. The converging tubular body 40 is disposed within the outer body 30 and, as such, the converging tubular body 40 and the outer body 30 cooperatively define an outer annular passage 60 between the interior surface 31 of the outer body 30 and the exterior surface 42 of the converging tubular body 40.

Both of the converging annular passage 50 and the outer annular passage 60 are receptive of a fluid 70, such as compressed air extracted from a compressor, at respective inlets 81 and 80 thereof such that the fluid 70 is directed to flow toward respective outlets 91 and 90 thereof The inlets 81 and 80 may be substantially coplanar with one another or otherwise disposed at substantially similar radial locations relative to the main flow through the combustor liner 20.

The outlet 90 of the outer annular passage 60 penetrates the combustor liner 20 to a predefined depth into the main flow.

The outlet 91 of the converging annular passage 50 penetrates the combustor liner 20 to at least the predefined depth into the main flow of the outlet 90. In some cases, the outlet 91 extends even further into the main flow through the combustor liner 20. That is, the converging tubular body 40 may have a length $L_1$, which is similar to or longer than a length $L_2$ of the outer annular body 30.

The fuel line 100 delivers fuel 101, such as one or more of natural gas, synthetic gas and oil, through at least the converging tubular body 40 at the converging section 401 to the converging annular passage 50. The fuel 101 is delivered in a direction that is, as shown in FIG. 3, substantially tangential relative to a circumferential curvature of the converging tubular body 40. By being delivered in the substantially tangential direction, the fuel 101 and the fluid 70 mix with one another. This mixing is due at least in part to shear forces generated between the fuel 101 and the fluid 70, which result in a cyclonic flow of fuel 101 and fluid 70 within the converging annular passage 50. A pressure of the cyclonic flow is maintained by the convergence of the converging tubular body 40.

Where the converging annular passage 50 is longer than the outer annular passage 60, the mixture of fluid 70 and fuel 101 may be injected into the main flow at a relatively low radial position of the combustor liner 20 as compared to the relatively high radial position of the injection of fluid 70 from the outer annular passage 60. As such, the fluid 70 injected from the outer annular passage 60 may serve as a barrier layer interposed between the fluid 70/fuel 101 mixture and an interior surface of the combustor liner 20 downstream from the fuel injector 10. This barrier layer may shield the interior surface of the combustor liner 20 from high temperature fluids and may, in some cases, extend downstream into a transition piece (TP) disposed in fluid communication with the combustor liner 20.

A terminal 102 of the fuel line 100 may be coplanar with the interior surface 41 of the converging tubular body 40 such that the interior surface 41 is substantially smooth even at the terminal 102.

The substantially tangential direction may be oriented transversely in relation to a predominant direction of fluid flow through the converging annular passage 50 and the outer annular passage 60. In some embodiments, the substantially tangential direction is oriented substantially perpendicularly relative to the predominant direction of the fluid flow through the converging annular passage 50 and the outer annular passage 60. In other embodiments, the fuel line 100 may be directed such that fuel 101 enters the converging annular passage 50 at either an incline or a decline relative to the predominant direction of the fluid flow through the converging annular passage 50 and the outer annular passage 60.

The fuel line 100 may be formed of piping extending from an exterior of the outer body 30, through the outer annular passage 60 and through the converging tubular body 40 and may include a plurality of individual fuel lines 110, 111 and 112. The number of these individual fuel lines may be two, three or more with each being separated by a constant or irregular interval. The individual fuel lines 110, 111 and 112 are oriented transversely relative to one another and may be coplanar or staggered. The individual fuel lines 110, 111 and 112 may also be substantially straight and in-line with the direction of fuel delivery to the converging annular passage 50.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector, comprising:

an outer body;

a converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof; and a fuel line to deliver fuel through at least the converging tubular body at the converging section to the converging annular passage in a substantially tangential direction relative to a circumferential curvature of the converging tubular body.

2. The fuel injector according to claim 1, wherein the fluid comprises compressed air.

3. The fuel injector according to claim 1, wherein the fuel comprises at least one or more of natural gas, synthetic gas and oil.

4. The fuel injector according to claim 1, wherein the fuel and the fluid form a cyclonically flowing mixture within the converging annular passage.

5. The fuel injector according to claim 1, wherein a terminal of the fuel line is coplanar with an interior surface of the converging tubular body.

6. The fuel injector according to claim 1, wherein the substantially tangential direction is oriented transversely relative to a predominant direction of fluid flow through the annular passages.

7. The fuel injector according to claim 1, wherein the substantially tangential direction is oriented substantially perpendicularly relative to a predominant direction of fluid flow through the annular passages.

8. The fuel injector according to claim 1, wherein the fuel line comprises a plurality of individual fuel lines.

9. The fuel injector according to claim 8, wherein each of the plurality of individual fuel lines are separated from one another by substantially constant intervals.

10. The fuel injector according to claim 8, wherein each of the plurality of individual fuel lines are oriented transversely relative to one another.

11. The fuel injector according to claim 1, wherein the fuel line extends from an exterior of the outer body and through the outer annular passage.

12. The fuel injector according to claim 1, wherein the respective outlets are substantially coplanar.

13. The fuel injector according to claim 1, wherein planes of the respective outlets are offset.

14. A fuel injector, comprising:

an outer body;

a converging tubular body having a length that is similar to or longer than that of the outer body, the converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof; and a fuel line to deliver fuel through at least the converging tubular body at the converging section to the converging annular passage in a substantially tangential direction relative to a circumferential curvature of the converging tubular body.

15. A late lean injection (LLI) combustor, comprising:

a liner defining a passage along which a main flow proceeds from an upstream section at which combustion producing the main flow occurs; and a fuel injector coupled to the liner downstream from the upstream section, the fuel injector comprising:

an outer body;

a converging tubular body including a converging section, defining a converging annular passage therein and being disposed within the outer body to define an outer annular passage between an interior surface of the outer body and an exterior surface of the converging tubular body, the annular passages each being receptive of a fluid at respective inlets thereof such that the fluid is directed to flow toward respective outlets thereof, which are respectively disposed within the liner; and a fuel line to deliver fuel through at least the converging tubular body at the converging section to the converging annular passage in a substantially tangential direction relative to a circumferential curvature of the converging tubular body.

16. The combustor according to claim 15, wherein the outlets of the outer annular passage and the converging annular passage are coplanar.

17. The combustor according to claim 15, wherein the outlet of the converging annular passage is located more deeply within the liner than the outlet of the outer annular passage.

18. The combustor according to claim 17, wherein fluid injected from the outer annular passage into the liner is interposed between the liner and fluid injected from the converging annular passage into the liner downstream from the fuel injector.

* * * * *